US005181797A

United States Patent [19]

Circeo, Jr. et al.

[11] Patent Number: 5,181,797

[45] Date of Patent: Jan. 26, 1993

[54] IN-SITU SOIL STABILIZATION METHOD AND APPARATUS

[76] Inventors: Louis J. Circeo, Jr., 4245 Navajo Trail, Atlanta, Ga. 30319; Salvador L. Camacho, 8913 O'Neal Rd., Raleigh, N.C. 27612

[21] Appl. No.: 827,384

[22] Filed: Jan. 29, 1992

[51] Int. Cl.[5] ..... E02D 3/11

[52] U.S. Cl. ..... 405/131; 405/229; 405/234; 405/258

[58] Field of Search ..... 405/128, 130, 131, 229, 405/234, 258

[56] References Cited

U.S. PATENT DOCUMENTS

| | | | |
|---|---|---|---|
| 3,293,863 | 12/1966 | Cox et al. | 405/131 |
| 4,376,598 | 3/1983 | Brouns et al. | 405/258 |
| 5,004,373 | 4/1991 | Carter | 405/131 |

FOREIGN PATENT DOCUMENTS

| | | | |
|---|---|---|---|
| 914715 | 3/1982 | U.S.S.R. | 405/131 |
| 958590 | 9/1982 | U.S.S.R. | 405/131 |
| 977570 | 11/1982 | U.S.S.R. | 405/131 |

*Primary Examiner*—David H. Corbin
*Attorney, Agent, or Firm*—Olive & Olive

[57] ABSTRACT

A method and apparatus for in-situ solidifying and stabilizing a mass of unstable foundation soil utilizes a plasma arc torch. The torch is inserted into a drilled and cased hole to a selected depth in a subterranean unstable soil layer and the torch is energized. The intense heat generated by the torch melts the soil material close to the hole and forms a pool of melt while more remote sections are baked to a brick-like consistency or dried and strengthened. Upon cooling, the central melted soil material cools to a hard, vitrified column with physical properties equivalent to a hard, dense rock. Variations of the method apply to a variety of construction support problems and landslide remediation problems.

23 Claims, 5 Drawing Sheets

IN-SITU SOIL STABILIZATION METHOD AND APPARATUS

FIELD OF INVENTION

This invention relates to the field of soil stabilization, and more particularly to methods and apparatus for increasing in-situ either the compressive or shear strength or both of selected portions of earthen material.

BACKGROUND OF INVENTION

The problem addressed by the invention concerns stabilizing earthen material by improving its load bearing strength under conditions of soft or unstable soil and rock. Such conditions occur and are of concern primarily in the areas of building support foundations and of steep rock or soil slopes such as at a building excavation site or on the side of a hill or mountain.

It often occurs that a construction project, be it a building, a bridge or another structure, is intended to be placed on land which is made up of unstable, or weak, foundation soil. The instability may be the result of inadequate compressive strength of the surface soil, of soil subject to excess settlement, or of a firm surface layer which resides over a soft or unstable underlayer. Conditions sometimes exist where an underlayer contains a high water content which is susceptible to lateral shifting or liquefaction. These conditions may be due, in some circumstances, to land which has been built up as a result of waste deposits such as landfills, sludge beds, mine tailings or earth dredged from under a body of water.

Soil liquefaction can take place in subterranean layers of water saturated sand. When the earth is vibrated such as during an earthquake, the sand particles lose grain-to-grain contact and are reoriented and densified to the point where the water pore pressure causes the subsurface layer to act as a liquid. Since water has no shear strength, the sand layers lose all stability causing existing surface structures to immediately settle, tilt, fall on their sides, or collapse. Soil liquefaction is the single largest factor in building destruction during earthquakes.

Many methods have been devised over the years to compensate for such soil conditions. Prominent among these methods have been the practices of driving load supporting piles into the ground or constructing an oversized load supporting foundation capable of "floating" on the weak soil. Very weak soil cannot be adequately stabilized with driven piles and, at great expense, must be excavated and replaced with stable foundation materials. In the distant past, excavated soil was sometimes heat treated in processing ovens and returned to the same site in a more stable condition. This procedure is not considered economically viable today.

Driving piles into the ground is a long process, requiring a large number of piles to be placed in close proximity so as to substantially supplement the weight supporting ability of the soil. A long-term danger exists with the method of inserting piles because over the life of a building or bridge, for example, the piles might decay, if made of wood, or rust, if made of metal. A pile made of concrete avoids the decay or rust problem, but tends to be more difficult to drive into the soil. Irrespective of the material of which the piles are made, the driven piles are forced into the ground until they either reach bedrock or the force required to drive exceeds a predetermined maximum. Since the depth to which a pile being driven into a particular soil cannot be predicted, some length of pile will be left above the ground. This excess length must be cut off flush with the foundation level so a flat surface will be available on which to build. A variation which has reduced the prior difficulties of driven piles involves cast-in-place concrete piles. The method of installing artificial piles requires a large number of piles if a substantial weight is to be supported and involves significant material and installation cost. Only piles which extend to bedrock will guarantee a firm structural foundation. The foundation stability of piles not able to reach bedrock could be compromised by weak underlying layers or by a change in soil properties such as caused by an increase in water content.

The alternate traditional solution for supporting a load on soft surface soil has been that of utilizing a "floating" foundation. Floating is accomplished by excavating a hole that is larger than the proposed building base and constructing a greatly oversized foundation. By effectively spreading the weight being supported over a large area, the tendency to settle is reduced. The floating foundation method requires an expenditure of considerable material and it is not always feasible to extend the dimensions of a foundation because of lack of available land or because of unsuitable topography. Again, the post-construction conditions outlined above in pile foundations could also threaten the stability of floating foundations.

A further method of foundation soil stabilization known in the construction industry is that of in-situ thermal hardening. To accomplish thermal hardening, a hole is drilled in the soil and the earth surrounding the hole is heated by oil or coal fuel so as to first drive off the moisture and later cure the soil to a tubular pile of brick-like hardness. This method is best suited to clay or loess based soils and tends to be very slow. A single prior art thermally hardened tubular pile sometimes requires several weeks to be formed.

A second aspect of the problem being described is that of correcting for differing rock and soil conditions on relatively steep inclines, such as found on a hill or mountain side. A mountain is generally made up of not one rock or soil, but of a plurality of individual rock and soil sections. There is often a layer of soil or of rock on the surface which is resting on underlying rock at a subterranean interface. When rain falls on the mountain, some of the water may find its way into the ground at the uphill place where the layer interface comes to the surface. The water continues to travel underground along the interface. The imposition of water at the interface creates a lubricated "slip plane" condition which, if the overlying layer is not prevented from sliding, for example, by an upwardly directed rock outcropping, could allow the overlying layer to slide down the mountain as a landslide. Similarly, slip planes can form in homogeneous earth masses which become unstable due to saturation, earthquake or other causes.

Modern geological testing methods allow the determination of the location, depth, and configuration of such slip plane interfaces. By locating earth masses susceptible to landslides, intervention can be accomplished before slides actually occur.

In the landslide conditions outlined above, remedial measures taken heretofore have been relatively expensive and not uniformly successful. A commonly known corrective method involves the construction of a protective retaining barrier at the base of a slope so as to prevent damage if a slide does begin. It has also been known to drill holes in the face of a mountain through its outer earthen mass and through the slip plane interface, pump concrete grout into the holes and then allow the grout to harden in order to stabilize the earthen mass. However, this system is very costly and has many disadvantages, e.g., the possibility of underground water reducing the concentration and strength of the concrete grout mix or the inability to determine exactly where the mix flows beneath the surface.

The invention disclosed herein recognizes that there exists a relatively new technology which may be employed in remediation of unstable land masses by the application of very high quantities of heat energy. The basic tool used in this technology is the plasma arc torch. Plasma torches can routinely operate at temperatures of 4000° C. to 7000° C. in the range of 85–93% electric to heat energy efficiency. The highest temperature attainable by combustion sources is in the vicinity of 2700° C.

A plasma arc torch operates by causing a high energy electric arc to form across a stream of plasma, or ionized gas, generating large amounts of heat energy. There are many types of plasma torches, but all torches generally fall into one of two basic categories according to the arc configuration relative to the torch electrodes, i.e., transferred arc type and non-transferred arc type. The arc of a transferred arc torch is formed by and jumps from a single electrode on the torch, through the gas, and to an external electrode which is connected to an opposite electrical pole. The arc of a non-transferred arc torch is formed by and jumps from one electrode on the torch across the plasma gas to another electrode on the torch.

In a plasma arc torch, the heat energy produced is proportional to the length of the arc, assuming an identical plasma gas at a uniform flow rate and a constant applied electrical current.

Since the present invention makes use of a plasma arc torch, reference is next made to U.S. Pat. No. 4,067,390 granted to the present inventors for "Apparatus And Method For The Recovery Of Fuel Products From Subterranean Deposits Of Carbonaceous Matter Using A Plasma Arc" which teaches the use of a plasma arc torch to gasify or to liquify underground deposits of coal oil shale and other carbonaceous materials. As with the method of the present invention, the method of the patent involves lowering a plasma arc torch into a hole and using the torch to create heat in the carbonaceous matter. In the method of the patent, the heat is used to gasify or liquify underground carbonaceous deposits and potential subsidence of the deposit overburdens is avoided by leaving pillars of earth at intervals for support. Also to be noted for further background is that the method of the patent involves monitoring selected properties of the fuel products and using the measured fuel properties as a means for adjusting the torch position at the base of the hole.

Having described the background art, the description next provides a summary of the invention and is followed by a more detailed description of the invention from which the differences between the method and apparatus of the invention and the prior art practices will become readily apparent.

SUMMARY OF THE INVENTION

The invention disclosed relates to a unique method and apparatus for the in-situ stabilization of unstable or soft earth by use of a plasma torch as applied to either soil intended to support construction or earthen masses susceptible to slope failure and landslides. The invention recognizes that by employing the extremely high and readily controllable temperatures achievable with a plasma torch, it becomes possible to melt and thermally stabilize rock and soil and form this stabilized heat-treated media into pile-like structures or into a complete heat-treated foundation for stabilizing or providing support in bodies of earth. The invention method and apparatus are directed to either an application in which the purpose is to stabilize foundation soil on which some form of construction is to be supported or to an application in which the purpose is to stabilize a body of earth, susceptible to slope failure.

The description will first assume that the application is that of stabilization of weak and unstable foundation soils to include deep subterranean layers which may be subject to excessive settlement or liquefaction. In this application, a hole is drilled into the surface of the earth to bedrock or to a depth at which the projected structural load can be supported. A tubular casing is inserted into the drilled hole to prevent sidewall collapse. The plasma torch, with connected electric, plasma gas and cooling water lines, is inserted to near the bottom of the cased hole and operated at a temperature sufficient to melt the surrounding soil or rock. The melting soil forms in a pool of melt which, as it becomes deeper, gets closer to the torch. The invention observes and takes advantage of the fact that as the melt level gets closer to the torch, the torch gas flow is resisted which acts to change the arc length and, consequently, the voltage across the torch electrodes. This change in torch voltage is further recognized and utilized by the method of the invention as a means for positioning the torch according to the proximity of the melt to the torch. The torch is moved, in response to a change in voltage, gradually up the hole while still operating so as to melt the earthen material and gradually form a vertical column of melted material rising from the bottom of the hole to the top of the hole. When a section of soil and rock is melted adequately to form the desired column, the torch operation is discontinued, the torch is removed, and the molten material is allowed to harden into a solid vitrified mass with physical properties equivalent to a hard, dense rock. The result is an underground column of vitrified and stabilized rock extending from a position at or below the bottom of the drilled hole to the surface. Thus, a stabilized, solid "pile" is created. Additional cased holes are formed and additional stabilizing columns are produced until a sufficient number of such columns are in place and operative to provide an overall bearing capacity sufficient to provide a stable foundation for the proposed structure. By proper spacing and depth of the cased boreholes, it is possible to stabilize a foundation to any depth with individual, separated pile-like structures, with a foundation in which the columns of heat-treated earthen material are coalesced together, or with a foundation in which the melted soil media is coalesced into a solid, hardened mass of vitrified material.

Having described how the method and apparatus of the invention are applied to foundation stabilization, a brief description will next be given of an application directed to preventing or resisting the tendency of one body of earth to slide on another body of earth.

In this example, a sufficient number of cased holes are drilled and a sufficient number of vitrified columns are formed in the steep slope in the manner previously explained but in this example the purpose is that of providing sufficient overall shear strength in the slip plane to prevent a slope failure or a landslide.

In another application of the invention as later explained in more detail, the foundation of an existing building or other structure is stabilized in-situ by forming plasma arc heat generated columns directly through the base of the structure or angled beneath the structure. A further application directed to stabilization of the slopes adjacent to an excavation for a building is also later explained.

In all the above examples, it is contemplated that several plasma arc torches could be operated simultaneously and several thermally stabilized columns formed simultaneously.

DESCRIPTION OF THE PREFERRED EMBODIMENTS

In the disclosure that follows, the terms "rock" and "soil" are periodically interchanged since soil is essentially disintegrated or finely ground rock. Unconventional foundation materials such as landfills, dredged materials and mine tailings should also be considered within the purview of the invention. When soil is heated above 200° C., irreversible improvements in the engineering properties take place, in particular, a decrease in water sensitivity which reduces swelling, compressibility, and plasticity and increases compressive and/or shear strength, resulting in a deplasticized soil mass. Above 500° C., soil plasticity is reduced effectively to zero. At about 900° C., the soil begins to solidify into a brick-like material as discussed above relative to in-situ thermal treatment. Finally, the soil melts at temperatures over 1100° C. and becomes fused into a hardened, vitrified mass upon cooling, with physical properties equivalent to a strong, dense rock and having a specific gravity in the range of 4.25. The invention recognizes and takes advantage of the fact that the vitrified material exhibits greatly increased compressive and shear properties. The invention disclosed further recognizes that similar significant improvements in the engineering properties may be obtained in the case of rock and soil formations, and in the aforementioned unconventional foundation materials.

Based upon the recognized physical characteristics of soil as described and upon what is believed to be a novel use and control of plasma arc torches, the disclosure that follows describes five specific embodiments as exemplary of the invention.

Figure 1:
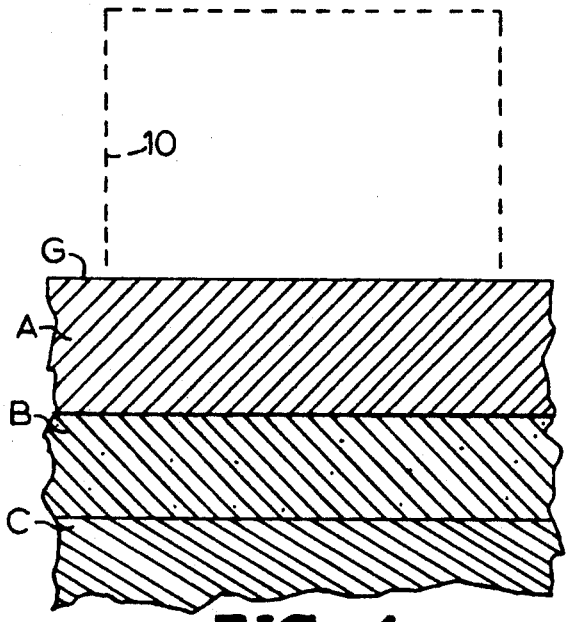
FIG. 1 is a cross sectional elevation view of a portion of earth showing layers of differing natural stability with the dashed outline of a proposed building above.

Making reference initially to the first embodiment, FIG. 1 illustrates a typical cross section of a segment of earth which, by way of example, is planned to become a foundation for a building 10 to be constructed. Building 10, outlined in dashed lines, is to be constructed on the earth at surface G. Building 10 is planned as a commercial or public use structure of fairly large size so as to require a strong foundation. It is assumed that the section of earth shown in the area beneath proposed building 10 does not exhibit sufficient foundation stability to support such a structure without stabilization, reinforcement or excavation and replacement of the poor foundation material. In the cross section shown, upper layer A is highly unstable, layer B is also unstable, but stronger than layer A and layer C is a stable, solid subterranean formation of bedrock. The sum of these three layers A, B, C affords insufficient foundation support for large building 10 to be built on surface G.

According to known technology, installing conventionally formed, structurally supportive piles from foundation surface G downward to stable, solid layer C could effectively overcome the instability of layers A, B. In contrast however, such columns as are formed by the process of the present invention utilizing a plasma torch avoid several disadvantages of older methods. First, the soil may be of such poor quality so as to preclude remediation by driven piles and require the soil to be excavated, removed and replaced with more stable foundation material. Second, the depth to layer C may be such that it would be impractical or impossible to reach it with piles. Third, the drawbacks of possible decay of wood or rust of metal are avoided. Fourth, the unpredictability of pour-in-place concrete is avoided. Fifth, a much greater number of driven piles may be needed than the number of heat stabilized columns.

By way of contrast, the invention recognizes that the plasma torch offers a fast and efficient source of heat which can be used to melt, vitrify and thermally stabilize large volumes of the earthen mass and form columns of the stabilized mass necessary for supporting a construction as in the first, second, third and fourth embodiments or for vitrifying and stabilizing large volumes of an earthen mass on both sides of and through a slip plane interface to stabilize a potential earth slide or the like. The method of the invention as further described below, comprises a faster, more efficient and more predictable means for stabilizing and solidifying masses of rock and earth than previously known.

Figure 2:
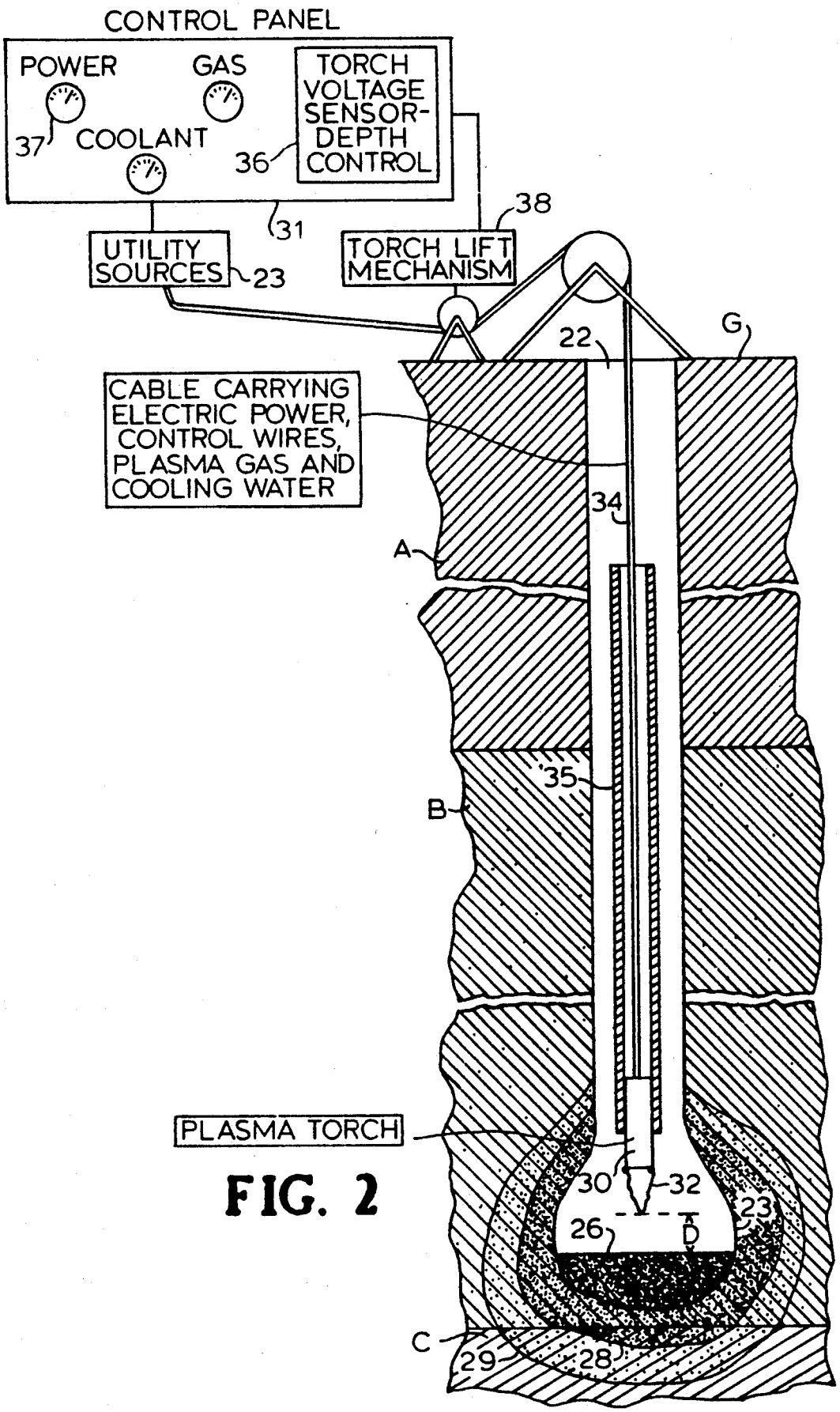
FIG. 2 is a cross sectional enlarged elevation view of the area of FIG. 1 having a drilled and cased hole formed through two upper unstable layers and into a lower stable layer with a plasma torch and related equipment and controls in place and operating according to a first embodiment of the invention.

As seen in FIG. 2, portraying the first embodiment, hole 22 has been drilled according to the invention from surface G through layers A, B and to the top of layer C. If the depth to layer C was uneconomical to reach, the holes 22 would be drilled to a depth at which the projected structural load could be supported. The depth where the interface between unstable layers A, B and stable layer C resides is normally determined during geological site investigations for the structure design. A typical plasma torch 30 with a one megawatt electrical power rating is of cylindrical shape and is approximately 22 cm in diameter. It is preferred to have the diameter of the drilled hole 5–10 cm larger than the diameter of the plasma torch. Therefore, hole 22 is drilled to have about a 30 cm diameter for clearance. To facilitate insertion and movement of torch 30, hole 22 is drilled vertically into the earthen mass. Plasma torches of high power ratings are proportionally larger in diameter. Torches rated at from 300 kw to 10 Mw power rating can be employed according to the conditions encountered, provided the hole diameter is adequate. A plasma torch applicable to the method and apparatus of the invention is produced by Plasma Energy Corporation, Raleigh, North Carolina. It is generally desirable to insert a substantially rigid casing made of any heat destructible material, such as thin metal, into drilled hole 22 to a depth approximately at the lowest position to which torch 30 will be put. The casing (not shown) acts to prevent sidewall collapse and to facilitate the movement of torch 30 down and up hole 22. In addition, a casing will prevent the hole from being continually flooded in case the drilling intercepts an underground body of water.

Plasma torch 30, preferably with arc forming means operative to form a non-transferred arc, is then lowered into hole 22 with plasma gas, electric supply and cooling water lines connected and carried by a common cable 34. A protective heat resistant shroud 35 is provided and extends upwardly from the upper portion of torch 30 to insulate the utility lines carried in cable 34 from damaging heat travelling convectively upward in hole 22. Torch 30 is energized to generate heat in the range 4000° C. to 7000° C., which is hot enough to readily melt the earthen materials immediately surrounding hole 22. When the torch is energized, the casing surrounding the torch is rapidly destroyed or melted by the heat created so as to expose the earth. Torch 30 transmits its heat energy by a combination of radiation and convection. The majority of the convection heat will travel upward along hole 22, and the radiation heat will begin to melt the earth in layer B around hole 22 and will create a substantially spherical opening 23 as the earthen mass melts at temperatures above approximately 1100° C. and collects in a pool 26. The heat transmitted from torch 30 will be conducted into the surrounding earth, resulting in thermally stabilized regions beyond the molten pool. Arbitrarily delineated thermal zones 28 and 29 depict segments which will become either fused to a brick-like consistency (zone 28) by heat between 900° C. and 1100° C. or become deplasticized (zone 29) by heat above 200° C.

Beyond the ability of a plasma arc to operate at exceedingly high temperatures, the energy generated is unusual in its frequency distribution. The energy generated by conventional combustion processes occurs mostly in the infra-red section, largely in the visible light section and marginally in the ultra-violet section of the energy spectrum. By contrast, the energy generated by a plasma arc will be as much as 29% in the ultra-violet spectrum. Ultra-violet energy wavelengths are able to penetrate gasses without measurable heat transfer and to penetrate solids more quickly and effectively than infra-red wavelengths.

While the method and apparatus of the invention are adapted to be used in association with a plasma arc torch operating in either a transferred arc mode or in a non-transferred arc mode, the invention method and apparatus are deemed best suited for use with a plasma arc torch operating in a non-transferred arc mode in which the arc extends between two electrodes on the torch.

Plasma torch 30, maintained in the initial position at maximum depth in hole 22, will continue to broadcast heat energy in all directions into the earth surrounding arc 32 until a time when the heat absorbing capacity of the earthen mass equals the heat generating ability of torch 30. At that time, continued operation of arc 32 merely serves to maintain the melted pool 26 and not accomplish further melting. In addition, the level of pool 26 will rise so that its surface is considerably closer to torch 30.

Figure 14:
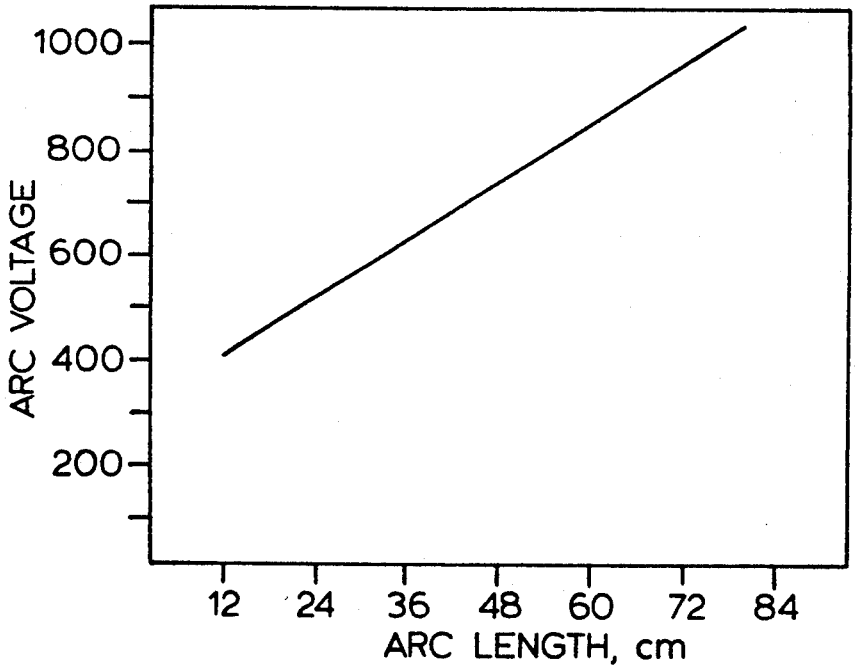
FIG. 14 is a graphical depiction of the relation between arc length and voltage in a typical plasma arc torch.

The operation of plasma torch 30 utilizes an ionized gas flowing under pressure and forms an electric arc supported by that gas. Input electric power is obtained from a power supply forming part of the utility sources 23 and is regulated by a device within suitable control panel 31. Control panel 31 preferably includes a microprocessor control designed so as to regulate the supply of power in a manner such that the electrical current remains constant through a wide range of conditions but the arc voltage is permitted to vary. The heat generated by arc-flame 32 of plasma torch 30 is proportional to the length of arc-flame 32. The invention recognizes that as the surface of pool 26 approaches arc-flame 32 the gas flow impinges that surface, the distance D (FIG. 2) lessens, and, in response to the resistance encountered by the gas, the flame 32 is diverted. The invention further recognizes that this change in flow of gas reduces the length of the arc-flame 32 and simultaneously causes the voltage drop across the arc to diminish with the shorter path and lower electrical resistance. Advantage is taken of this latter characteristic by recognizing that this reduction in resistance will be significant, and will be evidenced by the reading of power meter 37 which is connected so as to measure the voltage across the arc. FIG. 14 illustrates a typical graph of arc length against arc voltage in a system of a constant current and uniform plasma gas. As shown, a change in arc length results in a proportional and predictable change in arc voltage. Therefore, conversely, a change in arc voltage would directly indicate a proportional change in arc length.

In order to keep torch 30 operating at maximum effective-ness, and also to keep pool 26 from engulfing and extinguishing the arc-flame 32, cable lift mechanism 38 is activated to raise torch 30 incrementally in hole 22 so as to restore some preferred, predetermined distance D. Preferably, the cable lift mechanism 38 is controlled by a programmable microprocessor control 36 which continuously compares the measured plasma arc voltage against some predetermined minimum value and operates cable lift mechanism 38 to raise the torch so as to reestablish the arc voltage corresponding to the desired distance D. Programmable controllers as supplied by General Electric Company, Texas Instruments or Hewlett Packard are appropriate to the required function. Alternatively, the arc voltage could be visually monitored by an operator and the torch 30 raised by manual activation of the torch lift mechanism 38. Additional controls and meters for the gas supply, electric power and coolant are provided as illustrated in FIG. 2. In actual practice, the programmable controller operates with three distinct voltage signal points. Typically, detection of a first voltage point at about 10% below optimum will activate a first signal to alert an operator. Detection of a second voltage point at about 15% below optimum will activate a stronger signal to require the operator to decide whether to initiate corrective action. Detection of a third voltage point at about 20% below optimum will automatically, without operator intervention, initiate correction. If sufficient quantities of electric power, gas and coolant are available, it is feasible to operate a plurality of torches in separate holes simultaneously. In such cases, controls are arranged either to raise each torch individually according to the melt progress in its hole or to raise all torches in unison.

Figure 3:
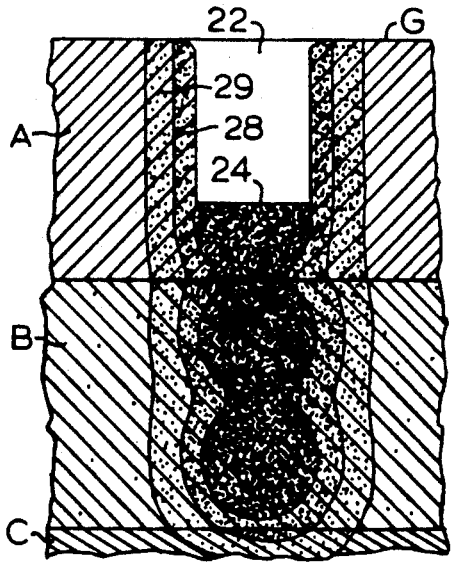
FIG. 3 is a cross sectional elevation view of the drilled hole of FIG. 2 after the plasma torch has formed a vitrified column of the earth surrounding the drilled hole.

With continuing reference to the first embodiment, as torch 30 melts successively higher portions of earthen material, the torch is lifted to generally create a continuous vertical column 24 as shown in FIG. 3. Column 24 may result in an irregular column of spherical segments or may be smoother in cylindrical shape. To achieve a more uniform diameter of column 24, the sensitivity of the voltage control to initiate upward movement is made finer, or movement is preset to a constant rate of speed. Obtaining maximum use of the generated heat from a megawatt power level plasma arc torch will, depending on soil properties, create a vitrified central column 24 of between 1–3 meters diameter, with the total solidified column diameter of thermally stabilized zone 29 extending up to 5 meters. As torch 30 is moved away and the molten material cools, a solid column of vitrified earth is formed with substantially increased density and great compressive strength with physical characteristics equivalent to a dense, hard rock. To the extent that the earth being melted contains metallic components, the melt and the residual vitrified column will also contain metal which has been melted and resolidified. In addition to the strength supplied by central column 24, more remote tube-like areas 28, 29 with brick and deplasticized earth properties contribute significant foundation stability and integrate with the surrounding earth mass that is not thermally modified. Since column 24 is composed of melted earthen material, the resultant, vitrified mass will be considerably more dense than the untreated soil material. The difference is of the order of twice the density of the initial material. As a result of the densification, there will be a proportional subsidence of the earth surrounding the hole as the earthen mass is melted. In FIG. 3, column 24 is completed with its upper segment in earth layer A, extending down to bedrock in layer C. Additional length of solidified column may be created by adding loose earth into hole 22 and continuing the melt process until a sufficient height of column 24 has been achieved. Alternatively, stable fill material can be used to fill the subsidence resulting from the vitrification process.

Figure 6:
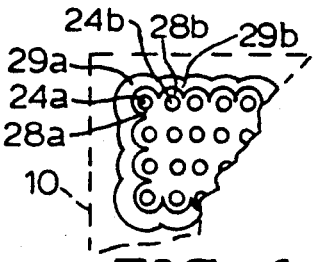
FIG. 6 is a plan view similar to FIG. 5 with the formed columns spaced closer together forming a mass of coalesced brick-like soil for greater structural support.
Figure 5:
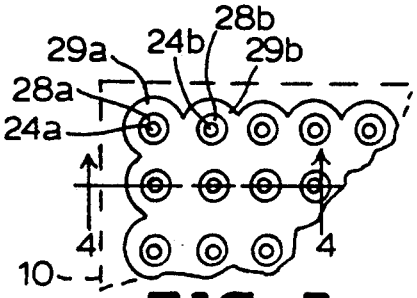
FIG. 5 is a plan view of a portion of a site on which a building is to be constructed with a number of completed columns shown and the proposed building corner shown in dashed lines.
Figure 4:
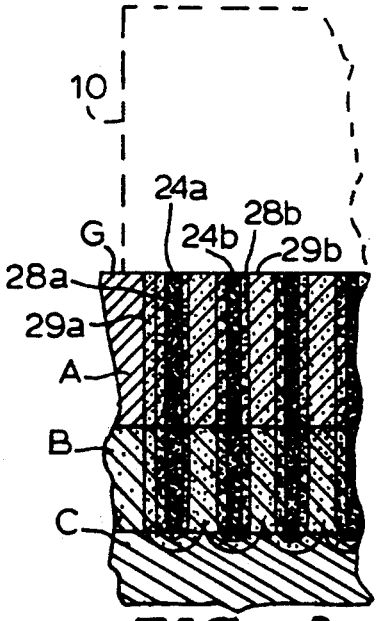
FIG. 4 is a cross sectional elevation view taken in the direction of line 4—4 of FIG. 5 of the earth portion showing a partial proposed building in dashed outline with formed columns completed by the method of the invention.

FIG. 4 depicts completed vitrified columns **24*a*, 24*b* in cross section which pass through layers A and B and terminate at surface G. In this situation, a building 10 could be constructed over the established columns 24*a*, 24*b*, etc. with adequate support. Supplemental to columns 24*a* are stabilized segments 28*a*, 29*a* contacting segments 28*b*, 29*b* of adjacent column 24*b*. FIG. 5 represents a plan view of a pattern of connected coalesced support columns composed of columns 24*a*, 24*b* and segments 28*a*, 28*b* and 29*a*, 29*b*. As seen, columns 24*a*, 24*b* are formed in proximity to one another so as to connect the related outer deplasticized areas. The effect of this connection is to establish an integrated, continuous support surface. An alternate pattern which may be employed is shown in FIG. 6 wherein columns 24*a*, 24*b* are formed in closer spacing such that intermediate zone 28*a*, 28*b* where brick hardness is obtained, is in contact from one column to the next. This embodiment results in greater support strength per area than is provided by the configuration of FIG. 5**, but also at somewhat higher cost.

The properties of various soils differ from one another, and therefore, the distance to which the heat will travel and stabilize the earthen mass is variable. To ensure that the columns are in the desired degree of contact, a single hole is initially drilled and processed according to the invention method. The results are measured to determine the extent of each of the three stabilized zones and then the balance of the area is drilled in a pattern so as to achieve the desired result. Tests are also conducted at this time to determine the correlation between the arc voltage and the distance of the torch above the melt as previously mentioned.

Figure 7:
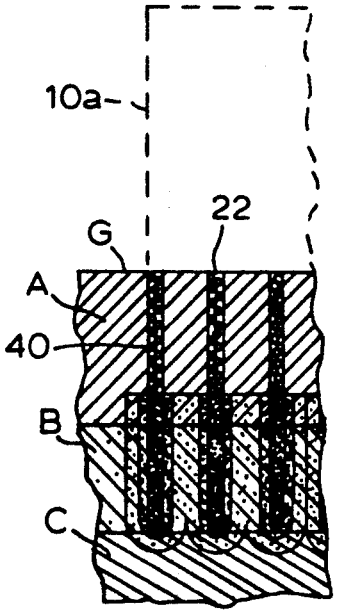
FIG. 7 is a cross sectional elevation view of a layered portion of unstable earth for future construction with a modified column formed with a vitrified earth column in the unstable layer and compacted gravel or concrete grout placed in the upper portion of the drilled hole according to a second embodiment of the invention.

FIG. 7 illustrates how a subterranean layer which is unstable or subject to liquefaction can be selectively stabilized. In this case, layers A and C are stable, and layer B is subject to liquefaction. The plasma torch 30 is operated only within layer B. Heat treatment will stabilize this layer as shown, effectively forming a stabilized bridge between stable layers A and C. The void created in layer B because of the vitrification and densification of the melted material must also be taken into account. If the layer A soil collapses into the cavity, the subsidence created on the surface can be readily filled. Otherwise, the underground void must be filled with concrete grout, rock 40 or any other stable material which can be injected in the holes 22.

The method described above is an effective and economical means to improve the foundation upon which a building is to be constructed. There are, however, instances when a building is already constructed and the existence of an unstable soil foundation is later discovered, for example, when the building is undergoing excessive settlement. With slight modifications, the previously explained method and apparatus of this invention may be applied to correcting the foundation problem beneath an existing building and is next described as a third embodiment.

Figure 8:
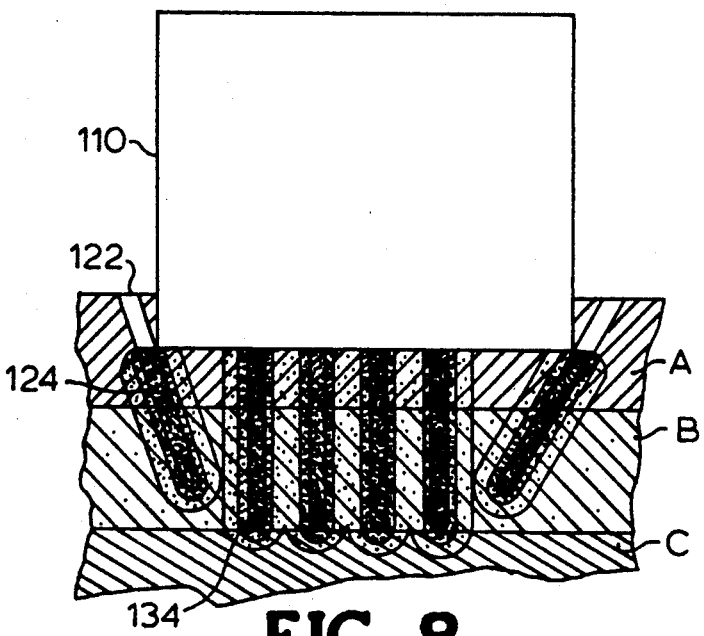
FIG. 8 is a cross sectional elevation view of a portion of the earth supporting an existing building which is prone to, or undergoing, excessive settlement and which condition has been remedied by the invention method using a plasma torch in a third embodiment.

According to FIG. 8, existing building 110 has been found to be on unstable soil and is beginning to undergo excess differential settlement, and is in danger of structural failure. A series of drilled and cased holes 122 are formed around the building at a slight angle to the vertical and directed at a point beneath the building so as to pass close to the lower edge of building 110 and below it to solid earth layer C. Following the method described above employing a plasma torch to generate high temperature, a vitrified column surrounded by solidified and deplasticized areas may be obtained. With drilled hole 122 close enough to existing building 110, a stabilized area will develop below the perimeter of building 110 and afford substantial support. It is not necessary to vitrify earth materials above the level of the bottom of building 110 in this example.

If access to the basement floor of the building is possible, the process of the invention may be further employed to form vitrified columns directly below the building. This method entails drilling holes 134 vertically downward through the lowest floor of the building and into the layers of soil below. As shown in FIG. 2, the plasma torch is then lowered into each drilled hole and the process of forming a vitrified column according to the invention is completed for each hole 134, resulting in added columns for support under the building. In this embodiment, grout is also used to fill up the subsidence voids under the foundation slab formed during the vitrification process.

The requirement to construct steep or vertical slopes in soil during construction presents another type of construction problem which may be effectively solved by the plasma torch method of creating vitrified columns in the earth. For example, in the course of excavating for a foundation in a soil medium, the danger often exists of sidewall collapse into the excavation. Prior techniques to control excavation sidewalls have included building an excavation bracing system or a temporary retaining wall, Pouring a concrete foundation wall in segments or installing refrigeration equipment to freeze the earthen walls in place. These techniques are all difficult, expensive and inefficient.

Figure 9:
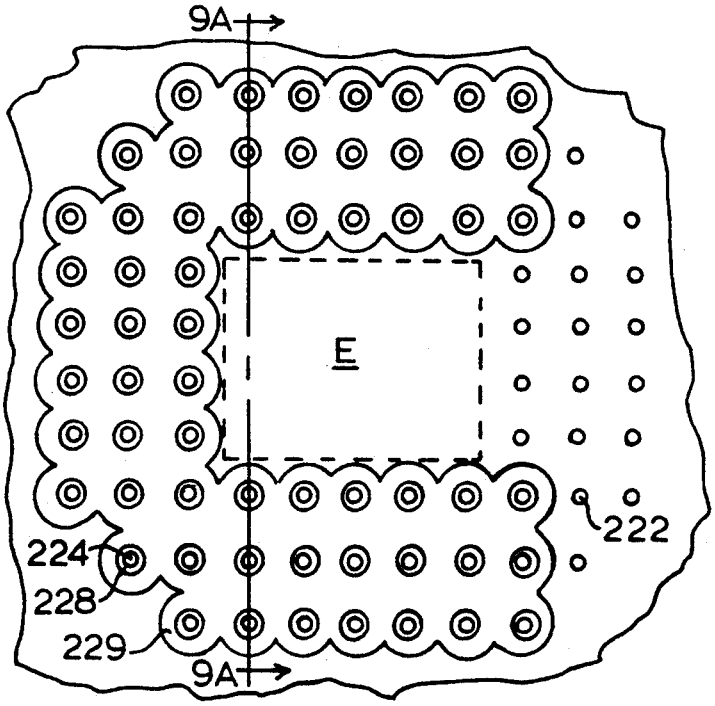
FIG. 9 is a top plan view of a portion of earth intended to support the construction of a building, with a series of vitrified columns formed to be permanent, stable walls surrounding the area to be excavated according to a fourth embodiment of the invention.
Figure 9A:
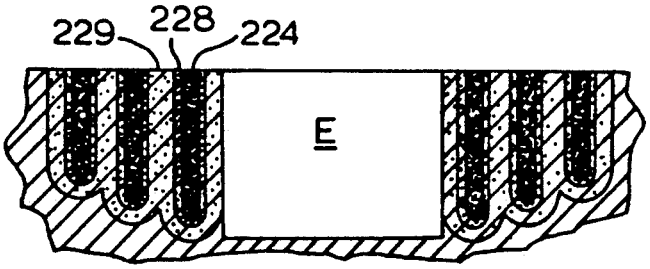
FIG. 9A is a cross sectional elevation view taken in the direction of line 9A—9A of FIG. 9.

Utilizing a fourth embodiment of the invention illustrated in FIGS. 9, 9A, it now becomes possible to stabilize vertical cuts in the boundary soils of a planned foundation excavation hole E before the actual excavation of the foundation hole has even begun. The area to be excavated is first surrounded by an outline of drilled and cased holes 222 which are spaced apart so that the final stabilized columns in each row will coalesce with one another. A plasma torch is lowered into each hole in sequence, energized and raised to cause a column to be established. The result is an individual column with a center vitrified portion 224, an intermediate brick-like portion 228 and an outer deplasticized portion 229. Cumulatively, the columns form a wall to encase the area to be excavated. Depending on the soil properties and the characteristics of the excavation, two or more rows of coalesced columns may be required to adequately stabilize the excavation sidewalls. The outer rows may be of equal depth or lesser depth than those of the inner row as seen in FIG. 9A. The excavation can then be accomplished to create vertical cuts without a significant collapse potential. By drilling the initial holes 222 to a depth below the bottom of the excavation or to a depth sufficient to contact a subterranean solid layer, the same piles 224 which prevent slope failure of the soil surrounding the planned foundation excavation may also be used to augment the foundation design of the building. Additional columns (not shown) may also be formed in the center of the excavation site as discussed in the first embodiment, to stabilize the foundation beneath the building to be constructed. Under these conditions, the subsidence resulting from the thermal stabilization process would lower the ground level and effectively reduce or eliminate the amount of material required to be physically excavated from the foundation.

In the various purposes and situations in which the method of plasma torch in-situ soil stabilization is employed, the degree of heat energy available may be controlled according to the needs. The basic torch has many forms and a variety of operating modes. The amount of input electrical energy and the type of plasma gas used will affect the heat and energy factors, and thus the degree of melting to take place. For example, a nitrogen plasma ionized gas may be utilized in an area having significant potential for combustion, thus removing the danger presented by the presence of oxygen. This capability would be important, for example, where the unstable foundation consists of waste materials such as found in municipal solid waste landfills. In general, however, the soil and rock normally encountered in a foundation are not combustible.

The second major problem to which the method and apparatus of the invention are applied is that of unstable slopes in both large and small land masses. For example, in the structure of a typical mountain, there are numerous segments of separate rock layers, sometimes being covered with several layers of soil. In a large number of situations encountered, the rock layers are engaged so as to form a stable grouping, unlikely to slide. In some of the situations, the layers of soil or rock are positioned on a downwardly angled face of a geologic formation such that the upper rock layer could slide down the angled face. Often there are layers of soil between the rock segments, which, when wet, may act as a lubricating agent to facilitate sliding, thus being designated as a "slip plane".

Figure 10:
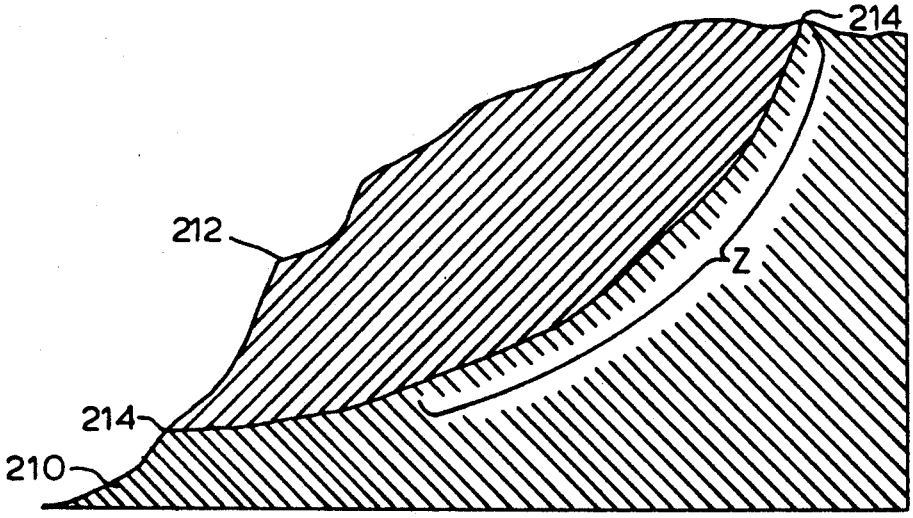
FIG. 10 is a cross sectional elevation view of a steep slope or portion of a mountain which contains an unstable earthen mass.

In FIG. 10, mountain 210, by way of example, has an outer body of earth 212 comprised either of rock or of soil which is situated on a downwardly sloping section such that the earthen material comprising segment 212 might slide relative to inner body 210 if so motivated. Such motivation could arise in the event of a reduction in the frictional forces holding earth segment 212 in place or in the event of a sudden severe vibration as would occur during an earthquake. Between mountain 210 and earth segment 212 is a mutually common subterranean area or slip plane interface, i.e. soil layers 214. The section of the slip plane interface marked Z and the unstable mass of earth 212 directly above it are known as the "active zone", being more prone to initiating a slide because of its steeper slope. When the outer layer of earthen matter comprising earth segment 212 is soil, interface 214 forms a part of earth segment 212, with no distinct demarcation between. In an instance of heavy rain, a significant amount of water may seep into the upper reaches of soil layer 214, run along the interface and lubricate the soil, thus reducing the friction maintaining the earth segment 212 in place, i.e., creating a slip plane.

Figure 11:
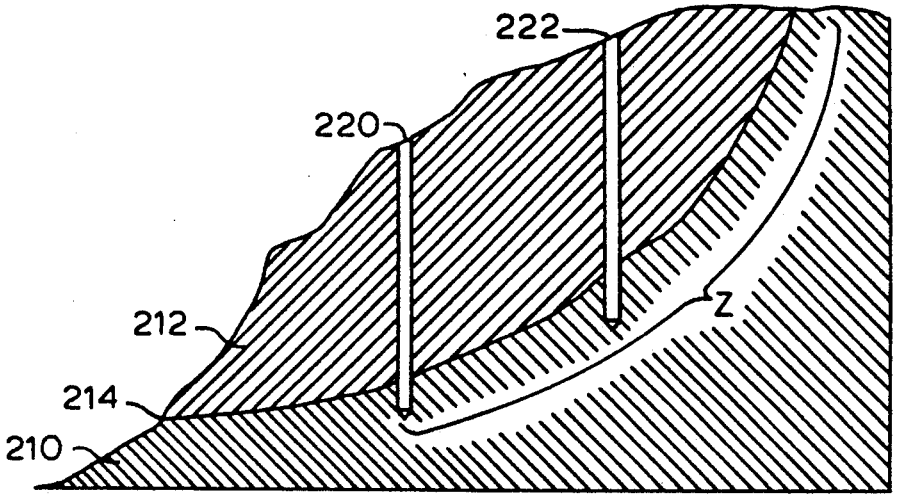
FIG. 11 is an enlarged view of FIG. 10 after drilling and casing two typical holes for the insertion of a plasma torch according to a fifth embodiment of the invention.

In FIG. 11, the same mountain segment is shown with holes 220, 222 drilled and cased as exemplary of the practice of the fifth embodiment of the invention. The orientation of each hole is preferably vertical so as to ease the movement of the plasma torch into and out of the drilled hole. The depth of the drilled holes is sufficient to cause the ultimate column created to be fully stabilized in the rock below interface 214.

Energizing the torch to create molten, vitrified, fused and deplasticized zones surrounding holes 220, 222 is carried out according to the invention similarly to the process previously described in respect to forming vitrified columns for soil stabilization. In the case of an unstable land mass on a mountain slope, it may be necessary only to rigidly connect the lower stable layer 210 to the upper unstable layer 212 to effectively destroy the integrity of the slip plane 214, meaning that the lower and upper layers 210, 212 are effectively joined together by vitrified columns penetrating the slip plane. However, depending on the susceptibility of layer 212 for failure, layer 212 should be stabilized upward beyond interface 214.

Figure 12:
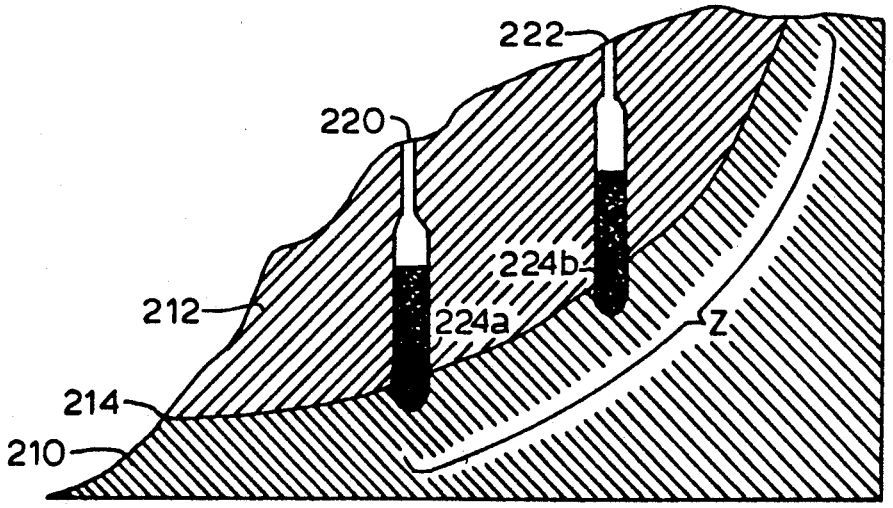
FIG. 12 is a view of FIG. 11 with the drilled holes replaced by vitrified stabilization columns according to the method of the invention.

FIG. 12 shows a sectional view of mountain 210 and earth segment 212 with holes 220, 222 having formed vitrified portions 224*a*, 224*b* according to the present invention. In effect this treatment firmly connects the loose soil or rock comprising earth segment 212 to the base mountain 210 and significantly reduces the possibility of relative shifting. Also shown is the extension of the stabilization process into the unstable active zone Z of layer 212.

Figure 13:
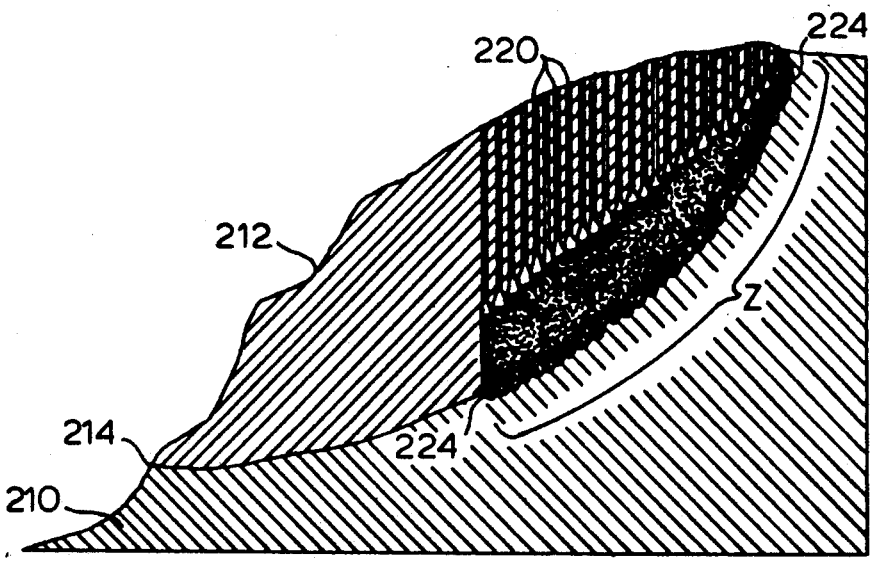
FIG. 13 is a view of FIG. 10 in which the instability has been corrected with a plurality of vitrified and coalesced columns across the slip plane and into the unstable mass of the slope according to a fifth embodiment of the invention.

The degree of stabilization and the quantity of drilled and cased holes will vary depending on the specific conditions found. FIG. 13 illustrates a situation in which, because of the incline of slip plane 214 and the low density of the upper mass 212, it is preferable to create a continuous pattern of drilled holes 220 and stabilized soil 224 in the vicinity of slip plane 214 in active zone Z. If necessary, the stabilized columns could be extended upward into the unstable active zone of layer 212, as shown. Because of the relatively low incline of the segment of slip plane 214 below active zone Z, further treatment in that area should not be required. This embodiment is directed to effectively destroy the integrity of the slip plane and thus, it may not be necessary to stabilize the entire active zone. Judgment as to the depth of holes and columns required depends on engineering measurements and analysis of soil characteristics.

The disclosure herein has been portrayed by a series of specific embodiments. Other variations to the major principles disclosed herein are applicable to the invention. Modifications as will be apparent to those skilled in the art are considered within the scope and spirit of the invention.

What is claimed is:

1. A method for solidifying a mass of earth to form a structural column comprising: (a) forming a hole to a predetermined distance into said mass of earth; (b) inserting a plasma arc torch into said formed hole; (c) energizing by applying a voltage to said torch to create a source of plasma arc heat sufficient to melt substantially in the absence of combustion a portion of said earthen mass; (d) while maintaining said torch energized, raising said torch out of said hole coordinated with the changing level of melt in said hole; deenergizing said torch; and (f) allowing said molten mass of earth to cool and said melt to solidify to form a structural column therefrom.

2. The method of claim 1, further comprising measuring the torch voltage and utilizing the results of this measurement to control the step of raising the torch within said hole.

3. A method for establishing a stable foundation to support a construction planned to be built upon a mass of unstable earth, comprising:

(a) forming a plurality of vertical holes in said earth below the planned position of said construction;

(b) inserting a plasma torch, into each said hole, said torch being supported by apparatus adapted to vertically position said torch in said hole and connected to appropriate electric, plasma gas and coolant sources;;

(c) energizing said torch when within each said hole to form a plasma arc as a primary source of heat;

(d) maintaining the position of said energized torch in each said hole for sufficient time to permit a portion of said mass of unstable earth to be melted substantially in the absence of combustion;

(e) raising said torch at a rate coordinated with the changing level of melt in said hole to melt additional unstable earth at a higher position within each said hole and permitting said additional melted earth to be deposited on previously formed melt;

(f) continuing to raise said torch and when a column of sufficient height to support said construction has been melted in each said hole, deenergizing said torch;

(g) removing said torch from said hole; and (h) allowing said melt to solidify into a vitrified column in each said hole.

4. The method of claim 3, in which said holes are formed of cylindrical configuration.

5. The method of claim 4, further comprising inserting a heat destructible casing into said formed cylindrical hole prior to energizing said torch and subsequently destroying said casing by the heat of said torch as said torch is raised gradually in said hole.

6. The method of claim 5, further comprising measuring the torch voltage and utilizing the results of this measurement to control the step of raising the torch within said hole so as to maintain a substantially constant distance between said torch and the upper surface of the melt produced by melting of said earth.

7. The method of claim 3, further comprising selecting the number and location of said plurality of holes so as to be adequate to support said construction.

8. The method of claim 6, further comprising forming an initial hole and inserting, energizing, raising, deenergizing and removing said torch from said initial hole so as to determine the effective diameter of said melt and thereby the space required between the remaining plurality of holes in order to provide some predetermined amount of support by the vitrified columns formed in said hole.

9. The method of claim 3, further comprising positioning said plurality of holes in such relative proximity so that the heat transmitted form said plasma torch through said mass of unstable earth beyond the portion being melted creates peripheral zones of solidified brick-like material and deplasticized material and the outer deplasticized material of each hole is coalesced with the respective deplasticized material of adjacent holes.

10. The method of claim 6, further comprising operating said plasma torch in a non-transferred mode.

11. A method for stabilizing a body of unstable earthen material surrounding an area to be excavated so as to prevent sidewall collapse, comprising:

(a) forming a plurality of vertical holes in said unstable earthen material along a periphery of an area to be excavated;

(b) inserting a plasma torch into each hole, said torch being supported by apparatus adapted to vertically position said torch in said hole and being connected to electric, plasma gas and coolant sources;

(c) energizing said torch within each said hole to form a plasma arc to melt said earthen material substantially int eh absence of combustion;

(d) gradually raising said torch at a rate coordinated with the changing level of melt in said hole to melt additional earthen material at a higher position within each hole;

(e) deenergizing said torch when a column of melted material of selected height has been formed;

(f) removing said torch from said hole; and (g) allowing said melted earthen material to cool and solidify into a vitrified column in each said hole.

12. A method of stabilizing an outer body of earth to an inner body of earth at a mutually common subterranean area along which the outer body of earth may shift relative to the inner body of earth unless the outer body of earth is stabilized, comprising:

(a) forming a selected number of substantially cylindrical vertical holes each of which passes completely through the outer body of earth desired to be stabilized, through the mutually common subterranean area and terminates at a selected depth within the inner body of earth;

(b) each said hole being formed such that below and above for some predetermined distance, and within said subterranean area the hole is surrounded by earthen material capable of being melted by the heat of a plasma torch;

(c) assembling a plasma torch of elongate cylindrical shape suited to slidably fit within said hole with appropriate plasma arc forming, electric, plasma gas, and coolant supply means and supported for adjustable vertical positioning in said hole;

(d) inserting said plasma torch into said inner body of earth to a selected depth in each said hole; and (i) energizing the torch when at the selected depth to create a plasma arc as a source of heat to convert the earthen material surrounding the hole to a melt and allowing such melt to collect in the bottom of the hole;

(ii) in coordination with continuously and remotely measuring with suitable means the distance between the torch plasma arc and the melt so as to maintain at least a predetermined minimum distance therebetween, raising the torch at some selected rate while continuing to produce further melt of earthen material until the torch has reached a position at which the melt forms a column extending from the bottom of the hole, through the common subterranean area and for said predetermined distance above such area;

(iii) at said position above said common subterranean area extinguishing said torch; and (iv) permitting each said column so formed to cool and solidify.

13. The method of claim 12, wherein said selected number of holes comprises a plurality of said holes formed such that the length, diameter, number and location of said holes are sufficient to effectively stabilize said outer body of earth to said inner body of earth through said common subterranean area and substantially resist shifting of said outer body of earth relative to said inner body.

14. The method of claim 12, wherein said suitable means for continuously and remotely measuring said distance comprises means for continuously and remotely measuring the torch arc voltage as an indication of said distance.

15. The method of claim 12, wherein said plasma arc forming means is operative to form a non-transferred plasma arc.

16. The method of claim 14, wherein said plasma arc forming means is operative to form a non-transferred plasma arc and said measured arc voltage comprises the voltage across said non-transferred arc.

17. A method of stabilizing an unstable earth foundation, overlying a stable body of earth, comprising:

(a) forming a selected number of substantially cylindrical vertical holes each of which terminates at a selected depth within the unstable layer or at the top of an underlying stable layer;

(b) assembling a plasma torch with appropriate plasma arc forming, electric, plasma gas, and coolant supply means and supported for adjustable vertical positioning in each of said holes;

(c) inserting said plasma torch to a selected depth in each of said holes and in each hole:

(i) energizing the torch when at the selected depth to create a plasma arc as a source of heat to form a melt of the earthen material surrounding the hole and allowing such melt to collect in the bottom of the hole and fill the hole to the extent of any larger diameter created by forming of the melt;

(ii) in coordination with continuously and remotely measuring with suitable means the distance between the torch plasma arc and the melt so as to maintain at least a minimum distance therebetween, raising the torch within the hole while continuing to produce further melt of the earthen material until the melt forms a vertical column extending from the bottom of the hole and for some predetermined distance above the stable body of earth;

(iii) then deenergizing said torch; and (iv) permitting each said column so formed to cool and solidify, the length, the diameter, and the number of said columns being selected such that said columns are able to support a predetermined load to be borne by said columns.

18. The method of claim 17, wherein said plasma arc forming means is operative to form a non-transferred plasma arc.

19. The method of claim 17, wherein said plasma arc forming means is operative to form a non-transferred plasma arc, said suitable means for continuously and remotely measuring said distance comprises means for continuously and remotely measuring the torch arc voltage as an indication of said distance and said measured arc voltage comprises the voltage across said non-transferred arc.

20. An apparatus for heating a subterranean mass of earthen material surrounding a substantially vertical hole passing therethrough, said earthen material being of a form that can be melted with the heat of a plasma arc torch, said apparatus comprising:

(a) a plasma arc torch having appropriate plasma arc forming, electric power, plasma gas and coolant supply means and being sized and supported for positioning within said hole;

(b) means for operating said torch to establish and sustain said arc so as to melt the earthen material surrounding the hole and form a melt therein;

(c) means for measuring the voltage across the plasma arc created by the torch as an indication of the distance of the torch arc from the melt; and (d) means for withdrawing said torch from said hole at some selected rate including said supply means in response to changes in said measured voltage so as to form a column of said melt in said hole.

21. The apparatus of claim 20, in which said plasma torch is of the non-transferred arc type and operates in a non-transferred arc mode.

22. The apparatus of claim 20, in which said means to withdraw said torch from said hole is automatically operative in response to changes in said measured plasma arc voltage.

23. In a method of soil stabilization in which a hole is formed in the earth, a plasma arc torch connected to appropriate electric, plasma gas and coolants sources is inserted into the formed hole and the plasma arc torch is energized and operated so as to melt the adjacent earth to form a molten pool, the method of measuring with suitable means the torch supply voltage as an indication of the distance between said torch and said molten pool and utilizing the results of this measurement to control a mechanism operative to raise said plasma torch in said hole so as to keep the distance between said torch and the top of said molten pool substantially constant.

* * * * *

UNITED STATES PATENT AND TRADEMARK OFFICE

CERTIFICATE OF CORRECTION

PATENT NO. : 5,181,797

DATED : January 26, 1993

INVENTOR(S) : Louis J. Circeo, Jr. and Salvador L. Camacho

It is certified that error appears in the above-identified patent and that said Letters Patent is hereby corrected as shown below:

Column 11, line 54, correct "Pouring" to read --pouring--.

Column 15, line 5, correct "form" to read --from--.

Column 15, line 25, correct "int eh" to read --in the--.

Signed and Sealed this

Twenty-third Day of November, 1993

*Attest:*

Bruce Lehman

BRUCE LEHMAN

*Attesting Officer*

*Commissioner of Patents and Trademarks*